US009284838B2

(12) United States Patent
Cernosek et al.

(10) Patent No.: US 9,284,838 B2
(45) Date of Patent: Mar. 15, 2016

(54) APPARATUS AND METHOD FOR OBTAINING FORMATION FLUID SAMPLES UTILIZING INDEPENDENTLY CONTROLLED DEVICES ON A COMMON HYDRAULIC LINE

(71) Applicants: James T. Cernosek, Missouri City, TX (US); Russell W. McEacharn, Kingwood, TX (US); Bernardo E. Pohl, Houston, TX (US); Marcelo F. Civarolo, The Woodlands, TX (US); Jorge O. Maxit, Houston, TX (US)

(72) Inventors: James T. Cernosek, Missouri City, TX (US); Russell W. McEacharn, Kingwood, TX (US); Bernardo E. Pohl, Houston, TX (US); Marcelo F. Civarolo, The Woodlands, TX (US); Jorge O. Maxit, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 416 days.

(21) Appl. No.: 13/767,588

(22) Filed: Feb. 14, 2013

(65) Prior Publication Data

US 2014/0224474 A1 Aug. 14, 2014

(51) Int. Cl.

| | |
|---|---|
| ***E21B 49/08*** | (2006.01) |
| ***E21B 49/10*** | (2006.01) |
| ***E21B 49/00*** | (2006.01) |

(52) U.S. Cl.

CPC ..... *E21B 49/10* (2013.01); *E21B 49/00* (2013.01); *E21B 49/08* (2013.01); *E21B 49/081* (2013.01)

(58) Field of Classification Search

CPC ..... E21B 49/10; E21B 49/08; E21B 49/081; E21B 49/00

See application file for complete search history.

(56) References Cited

U.S. PATENT DOCUMENTS

| | | | |
|---|---|---|---|
| 6,301,959 | B1 | 10/2001 | Hrametz et al. |
| 6,719,049 | B2 | 4/2004 | Sherwood et al. |
| 6,964,301 | B2 | 11/2005 | Hill et al. |
| 7,090,012 | B2 | 8/2006 | Hill et al. |
| 7,114,385 | B2 | 10/2006 | Fisseler et al. |
| 7,178,591 | B2 | 2/2007 | Del Campo et al. |
| 7,458,419 | B2 | 12/2008 | Nold, III et al. |
| 7,461,547 | B2 | 12/2008 | Terabayashi et al. |
| 7,484,563 | B2 | 2/2009 | Zazovsky et al. |
| 7,644,610 | B2 | 1/2010 | Meister |
| 7,757,760 | B2 | 7/2010 | Sherwood et al. |
| 7,836,951 | B2 | 11/2010 | Georgi et al. |
| 7,841,406 | B2 | 11/2010 | Zazovsky et al. |
| 7,857,049 | B2 | 12/2010 | Sherwood |
| 8,047,286 | B2 | 11/2011 | Zazovsky et al. |
| 8,082,780 | B2 | 12/2011 | Vannuffelen et al. |
| 8,091,635 | B2 | 1/2012 | Vasques et al. |
| 8,109,140 | B2 | 2/2012 | Tustin et al. |
| 8,151,878 | B2 | 4/2012 | Georgi et al. |
| 8,162,052 | B2 | 4/2012 | Goodwin et al. |

(Continued)

*Primary Examiner* — Yong-Suk (Philip) Ro
(74) *Attorney, Agent, or Firm* — Cantor Colburn LLP

(57) ABSTRACT

In one aspect, an apparatus for use in a wellbore formed in a formation is disclosed that in one embodiment includes a device for supplying a hydraulic fluid under pressure to a common hydraulic line, a first pump in hydraulic communication with the common hydraulic line via a first variable fluid control device, a second pump in hydraulic communication with the common hydraulic line via a second variable fluid control device, and at least one controller that controls flow of the hydraulic fluid from the first variable flow control device to the first pump and the flow of the hydraulic fluid from the second variable flow control device to the second pump to independently control the operation of the first pump and the second pump. In another aspect, the first pump is coupled to a first probe for extracting fluid from the formation and the second pump is coupled to a second probe for extracting the fluid from the formation.

20 Claims, 2 Drawing Sheets

(56) References Cited

U.S. PATENT DOCUMENTS

| | | | |
|---|---|---|---|
| 8,210,260 | B2 | 7/2012 | Milkovisch et al. |
| 8,215,389 | B2 | 7/2012 | Nold, III et al. |
| 8,220,536 | B2 | 7/2012 | Tao et al. |
| 2007/0079962 | A1 | 4/2007 | Zazovsky et al. |
| 2010/0132941 | A1 | 6/2010 | van Zuilekom et al. |
| 2010/0155061 | A1 | 6/2010 | Zazovsky et al. |
| 2011/0139448 | A1 | 6/2011 | Ciglenec et al. |
| 2011/0284219 | A1 | 11/2011 | Pomerantz et al. |
| 2012/0053838 | A1 | 3/2012 | Andrews et al. |
| 2012/0132419 | A1 | 5/2012 | Zazovsky et al. |
| 2014/0196532 | A1* | 7/2014 | Bullock et al. ..... 73/152.24 |

* cited by examiner

APPARATUS AND METHOD FOR OBTAINING FORMATION FLUID SAMPLES UTILIZING INDEPENDENTLY CONTROLLED DEVICES ON A COMMON HYDRAULIC LINE

BACKGROUND OF THE DISCLOSURE

1. Field of the Disclosure

The present disclosure relates generally to apparatus and methods for formation fluid collection and testing.

2. Description of the Related Art

During both drilling of a wellbore and after drilling, fluid (oil, gas and water) from the formation is often extracted to determine the nature of the hydrocarbons in hydrocarbon-bearing formations. Fluid samples are often collected in sample chambers and the collected samples are tested to determine various properties of the extracted formation fluid. To drill a well, drilling fluid is circulated under pressure greater than the pressure of the formation in which the well is drilled. The drilling fluid invades into the formation surrounding the wellbore to varying depths, referred to as the invaded zone, which contaminates the original fluid present in the invaded zone. To collect samples of the original fluid present in the formation, a formation testing tool is conveyed into the wellbore. A pump typically extracts the fluid from the formation via a sealed probe placed against the inside wall of the wellbore. The initially extracted fluid is discarded into the wellbore while testing it for contamination. When the extracted fluid is sufficiently clean, samples are collected in chambers for further analysis. Single and concentric probes have been proposed for extracting formation fluid. In concentric probes, separate pumps are used to extract fluid from the formation via an outer probe and an inner probe. The outer probe extracts the fluid present around the inner probe, which aids in removing the contaminated fluid more efficiently and may prevent fluid from the wellbore to flow into the inner probe. When the contamination level is at an acceptable level, the fluid from the inner probe is pumped into sample chambers, while the fluid from the outer probe is discharged into the wellbore or into a sample chamber for analysis.

Current formation testing systems typically utilize two or more pumps to perform specific functions, such as to extract fluid from the formation. Such systems utilize a single (or common) hydraulic bus or line to supply pressurized fluid to operate hydraulically-operated devices, such as the pumps, flow control valves and other devices. During operation, it is desirable to independently operate some of the devices coupled to the single hydraulic line and/or turn on some, but not all, of the devices. It is also desirable to turn on and turn off such devices when needed to maintain desired pressure in the common hydraulic line to save energy used for pumping the pressurized fluid.

The disclosure herein provides a formation evaluation system that allows independent operation of two or more pumps using a common hydraulic bus.

SUMMARY

In one aspect, an apparatus for use in a wellbore formed in a formation is disclosed that in one embodiment includes a device for supplying a hydraulic fluid under pressure to a common hydraulic line, a first pump in hydraulic communication with the common hydraulic line via a first variable fluid control device, a second pump in hydraulic communication with the common hydraulic line via a second variable fluid control device, and at least one controller that controls flow of the hydraulic fluid from the first variable flow control device to the first pump and the flow of the hydraulic fluid from the second variable flow control device to the second pump to independently control the operation of the first pump and the second pump. In another aspect, the first pump is coupled to a first probe for extracting fluid from the formation.

In another aspect, a formation testing tool is disclosed for obtaining fluid samples from a formation. In one embodiment the formation testing tool includes a first probe and second probe surrounding the first probe, wherein each of the first probe and the second probe is configured to sealingly contact a wall of a wellbore formed in a formation. The tool further includes a power unit that supplies a hydraulic fluid under pressure to a common hydraulic line, a first pump in hydraulic communication with the common hydraulic line via a first variable flow control device, a second pump in hydraulic communication with the common hydraulic line via a second variable flow control device. The first pump is in fluid communication with the first probe for extracting fluid from the formation and the second pump is in fluid communication with the second probe for extracting fluid from the formation. A controller independently controls the supply of the hydraulic fluid from the common hydraulic line to the first and second variable flow control devices to independently control the operation of the first and second pumps.

Examples of certain features of the apparatus and methods disclosed herein are summarized rather broadly in order that the detailed description thereof that follows may be better understood. There are, of course, additional features of the apparatus and methods disclosed hereinafter that will form the subject of the claims.

BRIEF DESCRIPTION OF THE DRAWINGS

For detailed understanding of the present disclosure, references should be made to the following detailed description, taken in conjunction with the accompanying drawings, wherein.

DESCRIPTION OF THE FIGURES

Figure 1:
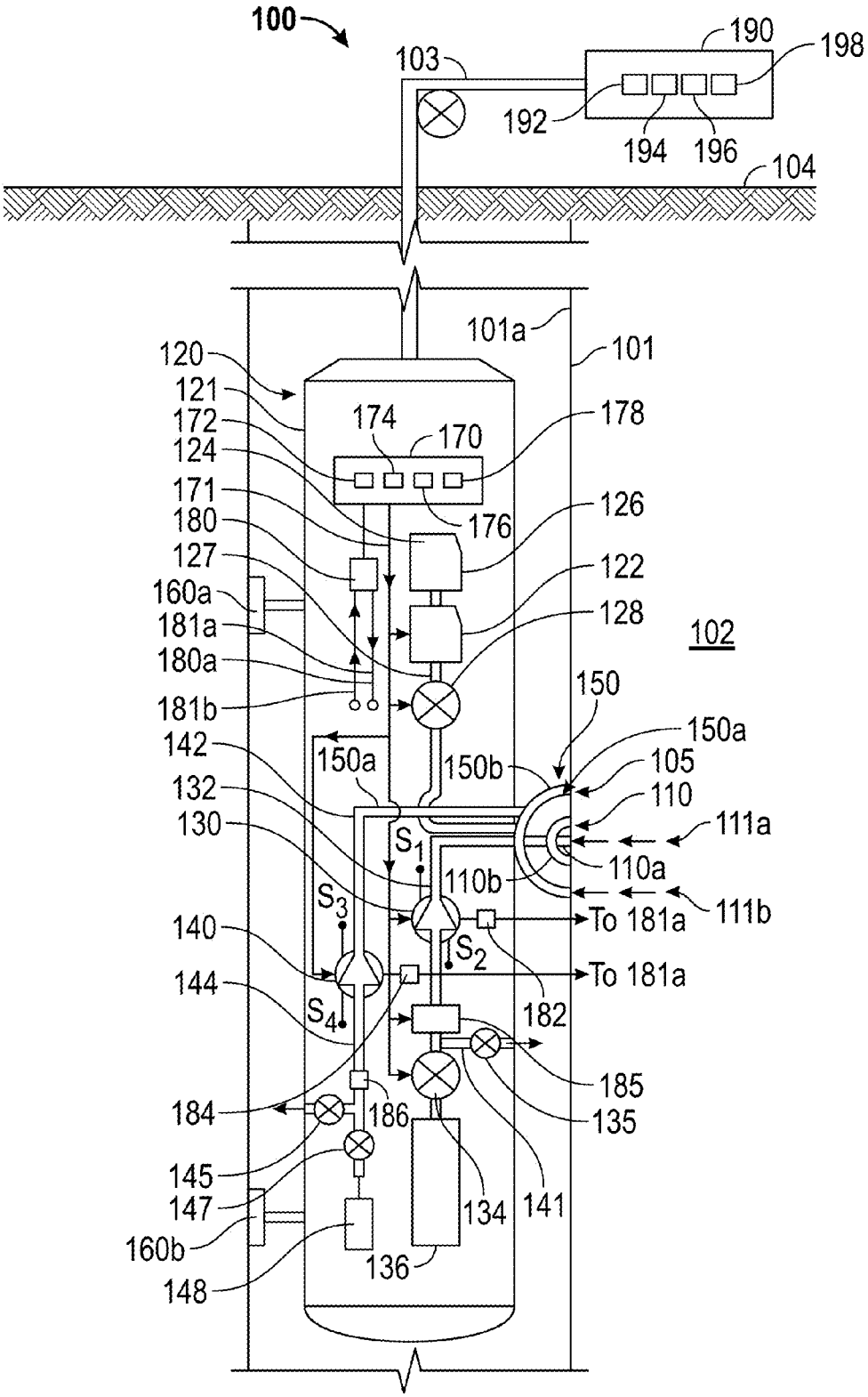
FIG. 1 is a schematic diagram of an exemplary formation testing system for obtaining formation fluid samples, according to one embodiment of the disclosure.

FIG. 1 is a schematic diagram of an exemplary formation evaluation system 100 for obtaining formation fluid samples and retrieving such samples for determining one or more properties of such fluid. The system 100 is shown to include a downhole formation evaluation tool 120 deployed in a wellbore 101 formed in a formation 102. The tool 120 is shown conveyed by a conveying member 103, such as a wireline, coiled tubing or a drilling tubular, from a surface location 104. In one embodiment, the tool 120 includes a fluid extraction or fluid withdrawal device 105 that includes an inner probe 110 and an outer probe 150. In one embodiment, probes 110 and 150 are concentric, as shown in FIG. 1. Probe 110 includes a fluid conduit or line 110*a* and a seal 110*b*, such as a pad or packer, around the conduit 110*a*. The outer probe 150 includes a conduit or fluid line 150*a* and a seal 150*b* around the conduit 150*a*. In one configuration, probes 110 and 150 may be extended from a tool body 121 radially outward toward the wellbore wall 101*a*. A pump 122 supplies a fluid 124 under pressure from a fluid chamber 126 to probes 110 and 150 via a fluid line 127 to extend and urge probes 110 and 150 against the inside wall 101*a* of the wellbore 101. Pads 160*a* and 160*b* on the opposite side of the fluid withdrawal device 105 are extended so that the probes 110 and 150, when extended, will urge against the wellbore wall 101*a*. A flow control device 128, such as a valve, associated with or in line 127, may be provided to control the flow of the fluid 124 to the probes 110 and 150.

A pump 130 is coupled to the inner probe 110 via a fluid line 132 for withdrawing fluid 111*a* from formation 102 via line 110*a*. To draw or extract fluid 111*a* from formation 102, pump 130 is activated, which extracts the fluid 111*a* into line 110*a*. The extracted fluid may be pumped into a chamber 136 via a flow control device 134 or discharged into the wellbore 101 via a fluid line 141 and the flow control device 134. A pump 140 is coupled to the outer probe 150 via a fluid line 142 for withdrawing fluid 111*b* from formation 102 via line 150*a*. To draw or extract fluid 111*b* from formation 102, pump 140 is activated to extract the fluid 111*b* into line 150*a* and thus line 142. The fluid withdrawn into line 142 may be discharged into the wellbore 101 via a line 144 and valve 145 or into a collection chamber 148 via line 146 and valve 147.

The tool 120 further includes a controller 170 that contains circuits 172 for use in operating various components of the tool 120, a processor 174, such as a microprocessor, a data storage device 176, such as a solid state memory, and programs 178 accessible to the processor 174 for executing instruction contained therein. The system 100 also includes a controller 190 at the surface that contains circuits 192, a processor 194, a data storage device 196 and programs 198 accessible to processor for executing instructions contained therein. Controllers 170 and 190 are in a two-way communication with each other and either alone or in combination may control the operation of the various devices in tool 120.

To obtain clean formation fluid samples, the tool 120 is conveyed and placed at a selected depth in the wellbore 101. Pads 160*a* and 160*b* are activated to contact the wellbore wall 101*a*. The inner probe 110 and outer probe 150 are activated to urge against the wellbore wall 101*a* to seal the probes 110 and 150 against the wellbore wall 101*a*. In one aspect, both the inner and outer probes 110 and 150 are activated simultaneously or substantially simultaneously. Pumps 130 and 140 are activated to draw the formation fluid into their respective probes. Activating pump 140 causes the fluid 111*b* around the probe 110 to flow into the outer probe 150, while activating pump 130 causes the fluid 111*a* to flow into the inner probe 110. The fluid initially drawn through the probes 110 and 150 (111*a* and 111*b*) is the fluid present in the invaded zone and is thus contaminated. A fluid evaluation or testing device 185 may be used to determine when the fluid 111*a* being withdrawn from probe 110 is sufficiently clean so that fluid samples may be collected. Similarly, a fluid evaluation device 186 may be utilized to determination the contamination level of the fluid 111*b* withdrawn from probe 150. Any device, including, but not limited to, an optical device, may be utilized for determining contamination in the withdrawn fluids. As long as the contamination in the fluid 111*a* being withdrawn from probe 110 is above a threshold or is otherwise not satisfactory, such fluid may be discharged into the wellbore 101 via a flow control device 135 and fluid line 141. Once the fluid 111*a* is clean (e. e., below a threshold), the fluid may be collected in sample chamber 136 by opening valve 134 and closing valve 135. The pump 140 continues to pump the fluid 111*b* from the probe 150 into the wellbore 101 or into chamber 148. The pumps and flow control devices in the tool 120 may be controlled by the controller 170 according to instructions stored in programs 178 and/or instructions provided by the surface controller 190. Alternatively, controller 190 may control the operation of one or more devices in the tool 120 according to instructions provided by programs 198.

Still referring to FIG. 1, in one embodiment, various devices in the tool 120, such as pumps 130 and 140, are hydraulically-operated devices and are controlled using a common hydraulic power unit 180 and a common or single hydraulic line 181*a* and a return line 181*b*. The hydraulic power unit 180 supplies a hydraulic fluid 180*a* under pressure to the common hydraulic line 181*a*, which fluid returns to the power unit 180 via the return line 181*b*. A variable flow control device 182 between the hydraulic line 181*a* and the pump 130 controls the supply of the hydraulic fluid 180*a* to pump 130, which controls the operation (for example speed) of the pump 130. Similarly, a variable flow control device 184 between the hydraulic line 181*a* and pump 140 controls the speed of the pump 140. Sensors S1 and S2 provide signals indicating end of the stroke in either direction of pump 130, while sensors S3 and S4 provide signals indicating end of the stroke in either direction of pump 140. Any suitable sensor, including, but not limited to, a magnetic switch and a Hall effect sensor, may be utilized for the purpose of this disclosure. Controllers 170 and/or 190 may be utilized to control the variable flow control devices 182 and 184 to independently control the pumps 130 and 140 and any other device in hydraulic communication with the hydraulic line 181*a* and to control starting and stopping of pumps 130 and 140 utilizing the signals provided by sensors S1, S2, S3 and S4, as described in more detail in reference to FIG. 2.

Figure 2:
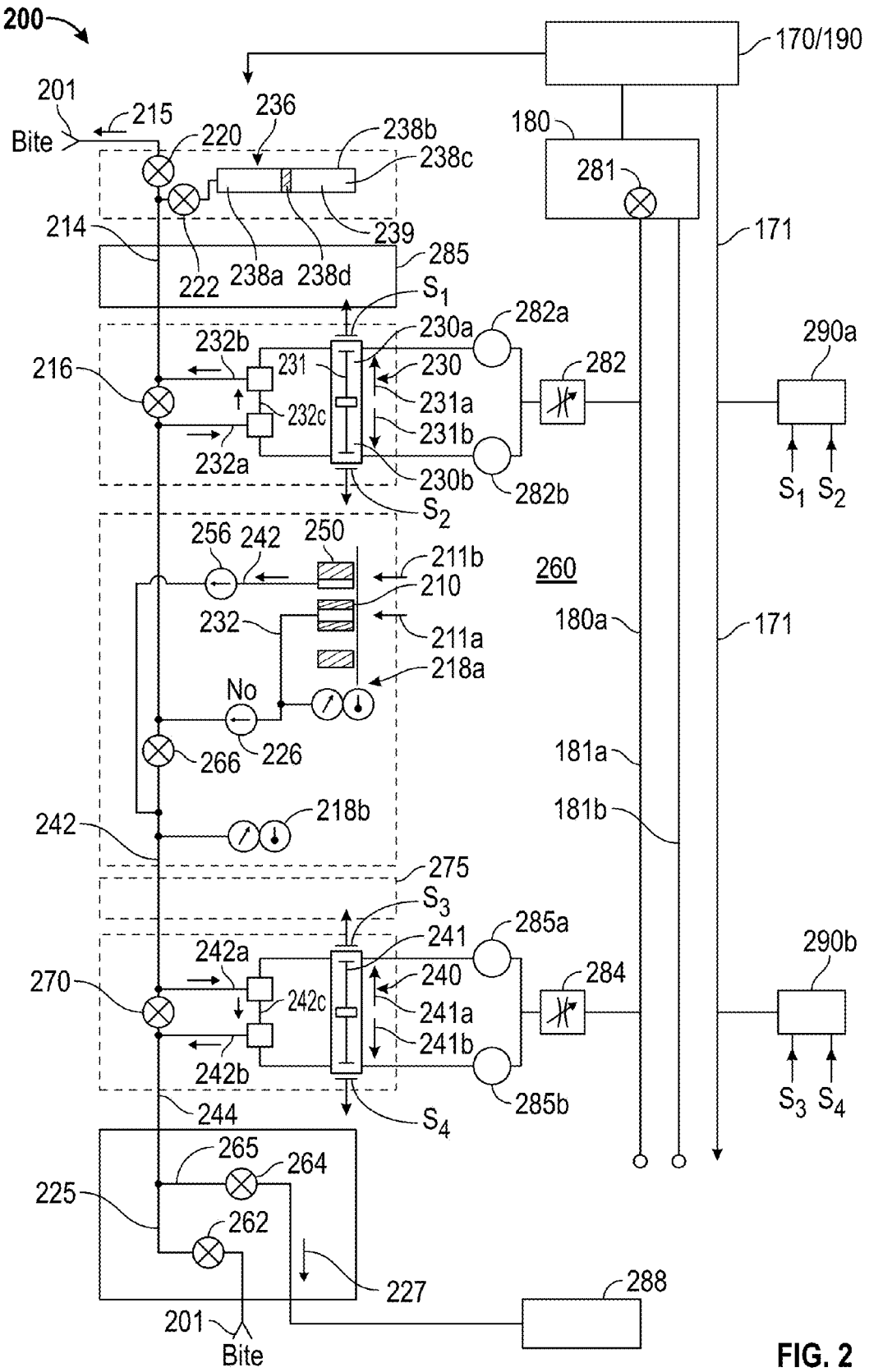
FIG. 2 is a line diagram of a formation testing tool that includes a common hydraulic line for independently controlling two or more hydraulically-controlled devices, such as pumps for extracting fluid via probes from a formation and sensors for controlling selected operation of the pumps, according to one embodiment of the disclosure.

FIG. 2 is a schematic line diagram of a formation evaluation tool 200, according to one embodiment of the disclosure that may be utilized in the system shown in FIG. 1. The tool 200 includes an inner probe 210 and an outer probe 250. In the particular embodiment of tool 200, probes 210 and 250 are concentric with the probe 250 surrounding probe 210. A pump 230 extracts formation fluid 211*a* from the formation 260 into fluid lines 232, 232*a* and 232*b* and connection line 232*c*. A flow control device 220 controlled by downhole controller 170 and/or surface controller 190 discharges the formation fluid 211*a* from line 214 into the wellbore 201 as shown by arrow 215. A flow control device 226 may be provided to control the flow of fluid from the pump 210. A flow control device 222 is provided to enable the fluid 211*a* to flow into a sample chamber 236. When the flow control device 220 is open and flow control device 222 is closed, the fluid from line 214 discharges into the wellbore 210 and when the flow control device 220 is closed and the flow control device 222 is open, the fluid from line 214 flows into the sample chamber 236. In one aspect, the sample chamber 236 includes a fluid storage chamber 238*a* for collecting the formation fluid 211*a* from line 214 and a force application device 238*b* for causing the storage chamber 238*a* to receive such formation fluid from line 214 against a selected pressure that maintains the fluid in chamber 238*a* above the formation fluid bubble point. In one aspect, the sample chamber 236 has a force application device 238*b* that may include a chamber 238*c* with a pressurized gas 239 that applies pressure or force on a piston 238*d* in chamber 238*a*. In another aspect, chamber 238*c* may be opened to wellbore pressure (the hydrostatic pressure) so that chamber 238*a* receives the formation fluid against the hydrostatic pressure. A fluid identification device 285 associated with or placed in line 214 provides measurements for determining when the formation fluid 111*a* extracted by probe 210 is clean. The fluid identification device 285 may be any suitable device, including, but not limited to, an optical device. For the purpose of this disclosure "clean" means that the contamination, such as mud, present in the extracted fluid 111*a* is at an acceptable level or meets (i.e., is at or below) a threshold.

Still referring to FIG. 2, the tool 200 includes a hydraulic power unit 180 that supplies the hydraulic fluid 180*a* under pressure to the common hydraulic line 181*a*, which fluid returns to the hydraulic power unit 180 via return line 181*b*. A variable flow control device 281, such as an electrically-controlled variable flow control valve, may be provided to control the flow of the hydraulic fluid 180*a* into the common hydraulic line 181*a*. The controllers 170 and/or 190 control the operation of the hydraulic power unit 180 and the flow control device 281. In one aspect, flow control devices 282*a* and 282*b* are provided to cause the piston 231 of pump 230 to reciprocate along directions 231*a* and 231*b* to extract the fluid 211*a* from the formation into one of the chambers 230*a* and 230*b* and expel such fluid from the other chamber into line 214. In one configuration, the flow control device 282 may be a variable flow control valve controlled by the controllers 170 and/or 190. To move the piston 231 of pump 230 in the direction 231*a*, flow control device 282*b* is activated or opened while the flow control device 282*a* is deactivated or closed. This causes the piston 231 to move in the direction 231*a*, expelling the fluid in chamber 230*a* into line 214 and causing chamber 230*b* to receive fluid from probe 210. To move the piston 231 in the direction 231*b*, flow control device 283*b* is closed and flow control device 283*a* is opened, which causes the fluid in chamber 230*b* to flow into line 214 and chamber 230*a* to receive fluid from the probe 210. The fluid from line 214 may then be expelled into the wellbore by opening valve 220 and closing the valve 222 or into the sample chamber 236 by closing valve 220 and opening valve 222.

Still referring to FIG. 2, pump 240 extracts the formation fluid 211*b* from the formation 260 via probe 250 and supplies the extracted fluid to line 244 via lines via lines 242, 242*a* and 242*b* and connection line 242*c*. The fluid 211*b* from line 244 may be selectively discharged into the wellbore 201 by opening a flow control device 262 and closing a flow control device 264 as shown by arrow 225 or into a collection chamber 288 by closing valve 262 and opening valve 264 as shown by arrow 227. A flow control device 256 may be provided to control the flow of the fluid 211*b* from pump 240. Additional flow control devices 266 and 270 may be provided to allow the fluid 211*b* to flow into line 214. A fluid identification device 275, such as an optical device, may be provided to determine the contamination level in the fluid 211*b* extracted from probe 240. Sensors 218*a* are provided to determine the pressure, temperature and flow rate of the fluid extracted via probes 210 and 250. Sensors 218*b* may be provided to determine pressure, temperature and flow rate of fluid through line 244.

Still referring to FIG. 2, sensor S1 provides a signal when the piston 231 of pump 230 is at the end of its stroke moving in the direction 231*a* and sensor S2 provides a signal when the piston 231 is at the end of the stroke moving in the direction 231*b*. Similarly, sensor S3 provides a signal when piston 241 of pump 240 is at the end of its stroke moving in the direction 241*a* and sensor S4 provides a signal when the piston 241 is at the end of the stroke moving in the direction 241*b*. In one configuration, when the piston 241 of pump 240 comes to an end of its stroke, for example traveling along the first direction 241*a*, the pump 240 stops and the signal from sensor S3 is sent to a local controller 290*b*. The controller 290*b* communicates with local controller 290*a*, which in turn causes the pump 230 to stop by controlling flow of the hydraulic fluid through a variable flow device 282 coupled to a common hydraulic line 181*a*. The controller 290*b* then causes the pump 240 to start by operating the variable flow control device 284 and valves 285*a* and 285*b* to cause the piston 241 to move in the second or opposite direction 241*b*. In this manner, each time piston 241 comes to the end of a stroke in a first direction, pump 230 is stopped by controlling the variable flow control device 282 coupled to the common hydraulic line 181*a* and then started when the piston 241 is caused to move in the second (opposite) direction by controlling the flow of the hydraulic fluid through the variable flow control device 282. Alternatively, signals from sensors S1 and S2 may be provided to the local controller 290*a*, which in turn sends such signals to the local controller 290*b*, which stops and starts pump 240 when the piston 231 of pump 240 stops and starts in the manner described above in reference to pump 240. In the configuration described above, pumps 230 and 240 are independently controlled using the common hydraulic line 181*a*. In another aspect, pumps 230 and 240 may be operated continuously without regard to when a pump stops. Also, controller 170 and/or 190 may be utilized to control the operation of pumps 230 and 240 in lieu of controllers 290*a* and/or 290*b*. Thus, in the configuration of the tool 200, each of the pumps 230 and 240 is independently controlled by selectively operating the flow control devices 282 and 284 from a common hydraulic line 181*a*. Other devices in the tool 200 may similarly be independently controlled utilizing the common hydraulic line 181*a*.

While the foregoing disclosure is directed to the embodiments of the disclosure, various modifications will be apparent to those skilled in the art. It is intended that all variations within the scope and spirit of the appended claims be embraced by the foregoing disclosure.

The invention claimed is:

1. An apparatus for use in a wellbore formed in a formation, comprising:

a device in the wellbore for supplying a hydraulic fluid to a common hydraulic line;

a first flow control device for controlling a supply of the hydraulic fluid from the common hydraulic line to a first pump;

a second flow control device for controlling a supply of the hydraulic fluid from the common hydraulic line to a second pump;

at least one controller that controls flow of the hydraulic fluid from the first flow control device to the first pump and controls a flow of the hydraulic fluid from the second flow control device to the second pump to independently control operation of the first pump and the second pump; and wherein the first pump operates at a first speed and the second pump operates at a second speed and wherein the second pump is turned off as a piston of the first pump reaches a selected position of the first pump.

2. The apparatus of claim 1, wherein the first flow control device is a first variable flow control valve and the second flow control device is a second variable flow control valve.

3. The apparatus of claim 2, further comprising a first pair of valves associated with the first pump and in fluid communication with the first flow control device and a second pair of valves associated with the second pump and in fluid communication with the second flow control device, wherein the first pair of valves and the first flow control device controls reciprocating action of the first pump and the second pair of valves and the second flow control device controls the reciprocating action of the second pump.

4. The apparatus of claim 1, further comprising a first probe in fluid communication with the first pump for extracting fluid from the formation and a second probe surrounding the first probe in fluid communication with the second pump for extracting fluid from the formation.

5. The apparatus of claim 4, further comprising a first fluid flow line in fluid communication with the first pump for supplying fluid extracted via the first probe into one of the wellbore or a sample chamber, and a second flow line in fluid communication with the second pump for supplying fluid extracted via the second probe into one of the wellbore or a collection chamber.

6. The apparatus of claim 5, further comprising a fluid analysis device for determining contamination level in one of: (i) fluid in the first fluid flow line; fluid in the second fluid flow lien; and (ii) fluid in the first fluid flow line and the second fluid flow line.

7. The apparatus of claim 4, further comprising a collection chamber in fluid communication with the second probe for receiving the fluid extracted by the second probe.

8. The apparatus of claim 7, wherein the collection chamber is at a pressure less than a pressure of the fluid in the second probe and wherein the fluid in the collection chamber is against a pressure less than a pressure in the second probe.

9. The apparatus of claim 1, wherein a speed of the first pump is different from a speed of the second pump.

10. The apparatus of claim 1, further comprising a hydraulic unit that supplies the hydraulic fluid to the common hydraulic line at one of: a constant pressure; and a variable pressure.

11. The apparatus of claim 1, wherein the first pump reaches an end of a stroke before the second pump reaches an end of a stroke.

12. The apparatus of claim 11, wherein the controller controls the second flow control device to stop the second pump in response to stopping of the first pump and controls the second flow control device to start the second pump in response to starting of the first pump.

13. The apparatus of claim 11, wherein the controller controls the second flow control device to stop the second pump in response to the first pump stopping and controls the second flow control device to start the second pump in response to the first pump starting.

14. The apparatus of claim 1, wherein the at least one controller includes a first local controller for controlling operation of the first pump and a second local controller for controlling operation of the second pump.

15. A system for obtaining a sample from a formation, comprising:

a tool conveyable in a wellbore formed in the formation, the tool including:

a first probe for obtaining fluid from the formation;

a second probe for obtaining fluid from the formation;

a device for supplying a hydraulic fluid to a common hydraulic line;

a first pump for extracting the fluid from the formation via the first probe;

a first flow control device for controlling a supply of the hydraulic fluid from the common hydraulic line to the first pump;

a second pump for extracting the fluid from the formation via the second probe;

a second flow control device for controlling a supply of the hydraulic fluid from the common hydraulic line to the second pump;

a fluid evaluation device for determining level of contamination in the fluid extracted via one of the first probe and the second probe; and at least one controller that controls flow of the hydraulic fluid from the first flow control device to the first pump and controls a flow of the hydraulic fluid from the second flow control device to the second pump to independently control operation of the first pump and the second pump.

16. The system of claim 15, wherein the tool is conveyable by one of wireline and a drilling tubular.

17. The system of claim 15, wherein the first flow control device is a first variable flow control valve and the second flow control device is a second variable flow control valve.

18. The system of claim 17, further comprising a first pair of valves associated with the first pump and in fluid communication with the first flow control device and a second pair of valves associated with the second pump and in fluid communication with the second flow control device, wherein the first pair of valves and the first flow control device controls action of the first pump in a first direction and a second direction and the second pair of valves and the second flow control device controls action of the second pump in a first direction and the second direction.

19. The system of claim 15, further comprising a first fluid flow line in fluid communication with the first pump for supplying fluid extracted via the first probe into one of the wellbore or a sample chamber, and a second flow line in fluid communication with the second pump for supplying fluid extracted via the second probe into one of the wellbore or a collection chamber.

20. The system of claim 15, wherein the controller stops and starts one of the first pump and the second pump in response to the other of the first pump and the second pump stopping and starting.

* * * * *